US006710531B2

(12) United States Patent
Reed et al.

(10) Patent No.: US 6,710,531 B2
(45) Date of Patent: Mar. 23, 2004

(54) CRT HAVING A SHADOW MASK VIBRATION DAMPER

(75) Inventors: Joseph Arthur Reed, York, PA (US); Gary Lee Diven, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 10/036,631

(22) Filed: Dec. 21, 2001

(65) Prior Publication Data

US 2003/0117058 A1 Jun. 26, 2003

(51) Int. Cl.[7] ..... H01J 29/80
(52) U.S. Cl. ..... 313/407; 313/402
(58) Field of Search ..... 313/402, 404, 313/405, 407, 408, 269, 50

(56) References Cited

U.S. PATENT DOCUMENTS

| | | | | | |
|---|---|---|---|---|---|
| 4,827,179 | A | * | 5/1989 | Adler et al. | 313/402 |
| 5,406,168 | A | | 4/1995 | Takagi | 313/402 |
| 5,451,833 | A | * | 9/1995 | Tong | 313/402 |
| 6,157,121 | A | | 12/2000 | Ragland, Jr. et al. | 313/403 |
| 6,469,429 | B1 | * | 10/2002 | Berton | 313/402 |
| 6,469,431 | B1 | * | 10/2002 | Suzuki et al. | 313/407 |
| 6,489,714 | B2 | * | 12/2002 | Kim | 313/407 |
| 6,520,475 | B2 | * | 2/2003 | Haun et al. | 248/636 |
| 6,590,328 | B2 | * | 7/2003 | Shin et al. | 313/407 |
| 6,605,890 | B1 | * | 8/2003 | Tanabe et al. | 313/403 |
| 6,608,433 | B1 | * | 8/2003 | Kodama et al. | 313/402 |
| 6,614,152 | B1 | * | 9/2003 | Berton et al. | 313/402 |
| 2001/0020814 | A1 | | 9/2001 | Kim | 313/407 |
| 2002/0079805 | A1 | | 6/2002 | Michalchuk | 313/402 |

FOREIGN PATENT DOCUMENTS

| | | | | |
|---|---|---|---|---|
| EP | 01206544 | | 8/1989 | H01J/29/07 |
| EP | 11250825 | | 2/1998 | H01J/29/07 |
| EP | 0 911 857 | A2 | 10/1998 | H01J/29/07 |
| EP | 2000011912 | | 1/2000 | H01J/29/07 |
| EP | 0 984 482 | A2 | 3/2000 | H01J/29/07 |
| EP | 0 984 482 | A3 | 5/2000 | H01J/29/07 |
| EP | 1 098 349 | A1 | 5/2001 | H01J/29/07 |
| EP | 2001135254 | | 5/2001 | H01J/29/02 |
| JP | P2000-11912 | A | 6/1998 | H01J/29/07 |
| JP | 2000-11912 | | 1/2000 | H01J/29/07 |
| JP | 2001-135254 | | 5/2001 | H01J/29/02 |
| WO | WO 02/39477 | A2 | 5/2002 | H01J/29/07 |

OTHER PUBLICATIONS

PCT International Search Report, app. No. PCT/US02/38396, dated Jul. 7, 2003.

* cited by examiner

*Primary Examiner*—Sandra O'Shea
*Assistant Examiner*—Peter Macchiarolo
(74) *Attorney, Agent, or Firm*—Joseph S. Tripoli; Joseph J. Laks; Carlos M. Herrera

(57) ABSTRACT

The invention provides an improved vibration damper for use in a tension mask assembly of a CRT. The improved vibration damper is provided along edges of a tension mask which is attached to a support frame. The vibration damper consists of an elongated strip member having first and second ends mounted to a surface of the tension mask along its borders. A substantial portion of the elongated strip member located between the first and second ends lies in frictional contact with the tension mask to receive vibrations induced in the mask.

18 Claims, 5 Drawing Sheets

FIG. 3
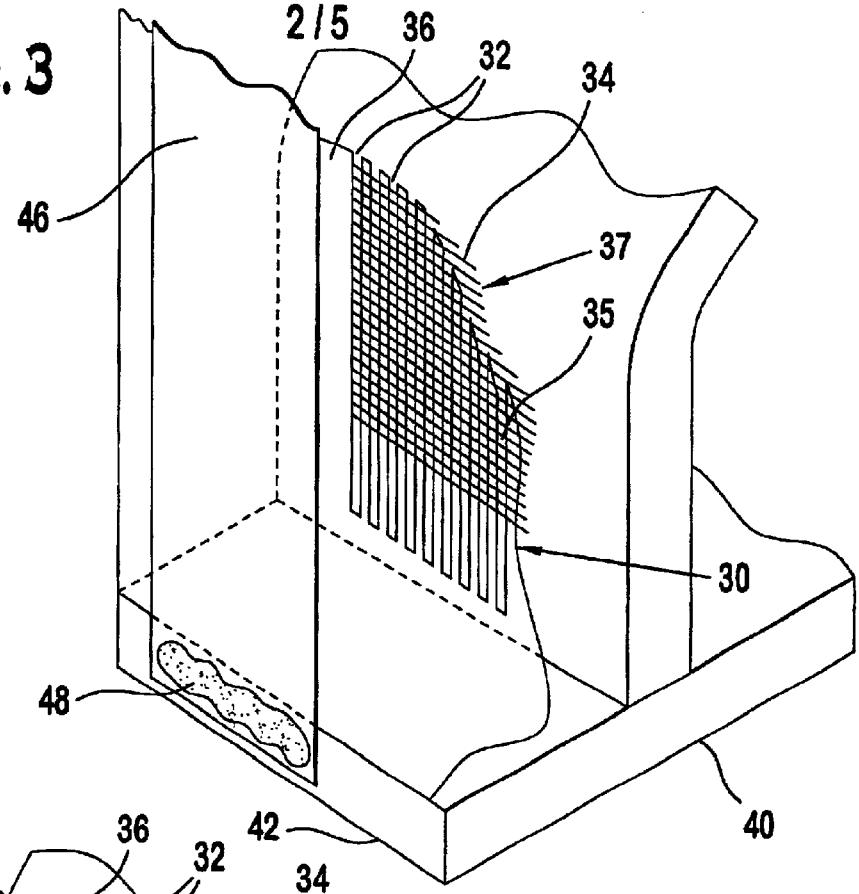
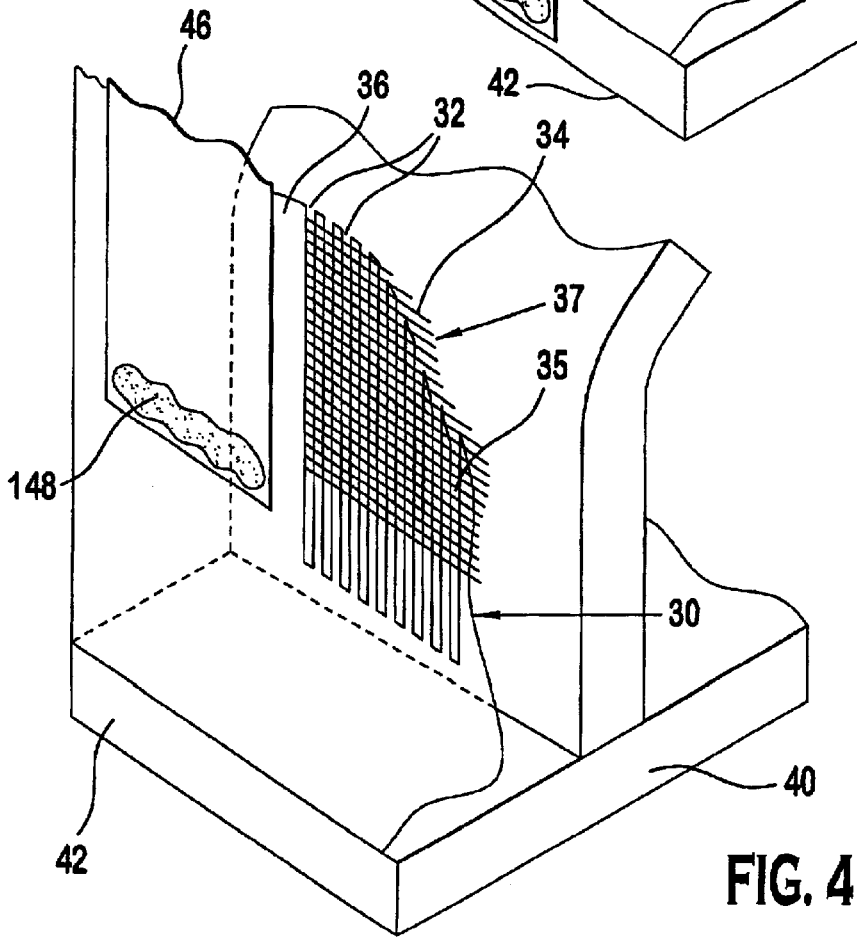
FIG. 4

CRT HAVING A SHADOW MASK VIBRATION DAMPER

FIELD OF THE INVENTION

This invention relates generally to cathode ray tubes (CRTs) and more particularly to a tension mask assembly having a vibration damper applied to an area of the tension mask.

BACKGROUND OF THE INVENTION

A color cathode ray tube, or CRT, includes an electron gun for forming and directing three electron beams to a screen of the tube. The screen is located on the inner surface of the faceplate panel of the tube and is made up of an array of elements of three different color-emitting phosphors. A shadow mask, which may be either a formed mask or a tension mask having strands, is located between the electron gun and the screen. The electron beams emitted from the electron gun pass through apertures in the shadow mask and strike the screen causing the phosphors to emit light so that an image is displayed on the viewing surface of the faceplate panel.

One type of CRT has a tension mask comprising a set of strands that are tensioned onto a mask support frame to reduce their propensity to vibrate at large amplitudes under external excitation. Such vibrations would cause gross electron beam misregister on the screen and would result in objectionable image anomalies to the viewer of the CRT.

One method of tensioning a mask utilizes a mask support frame having a pair of support blade members mounted on opposite sides of the frame parallel to the major axis of the tension mask. The tension mask extends between the support blade members and is held in tension to reduce its propensity to vibrate. A problem exists in that the support blade members supporting the mask are subject to vibration relative to the frame when external vibration or microphonic vibration is applied to the frame. Such external vibrations may then be undesirably transferred to the tension mask.

SUMMARY OF THE INVENTION

The invention provides a CRT having a tension mask and a vibration damper to receive vibration from the tension mask. The tension mask is attached to a support frame, wherein the support frame has longs sides (22, 24) parallel to a major axis and shorts sides parallel to a minor axis (26, 28). The tension mask includes borders which are near the short sides and parallel therewith. The vibration damper comprises an elongated strip member having first and second ends mounted at respective attachment locations along the border and a major portion which is in frictional contact with the border.

BRIEF DESCRIPTION OF THE DRAWINGS

The invention will now be described by way of example with reference to the accompanying figures of which:

FIG. 3 is a partial perspective view of the lower corner portion shown in FIG. 2.

FIG. 4 is a partial perspective view similar to that of FIG. 3 for a first alternate embodiment.

DETAILED DESCRIPTION OF THE INVENTION

Figure 1:
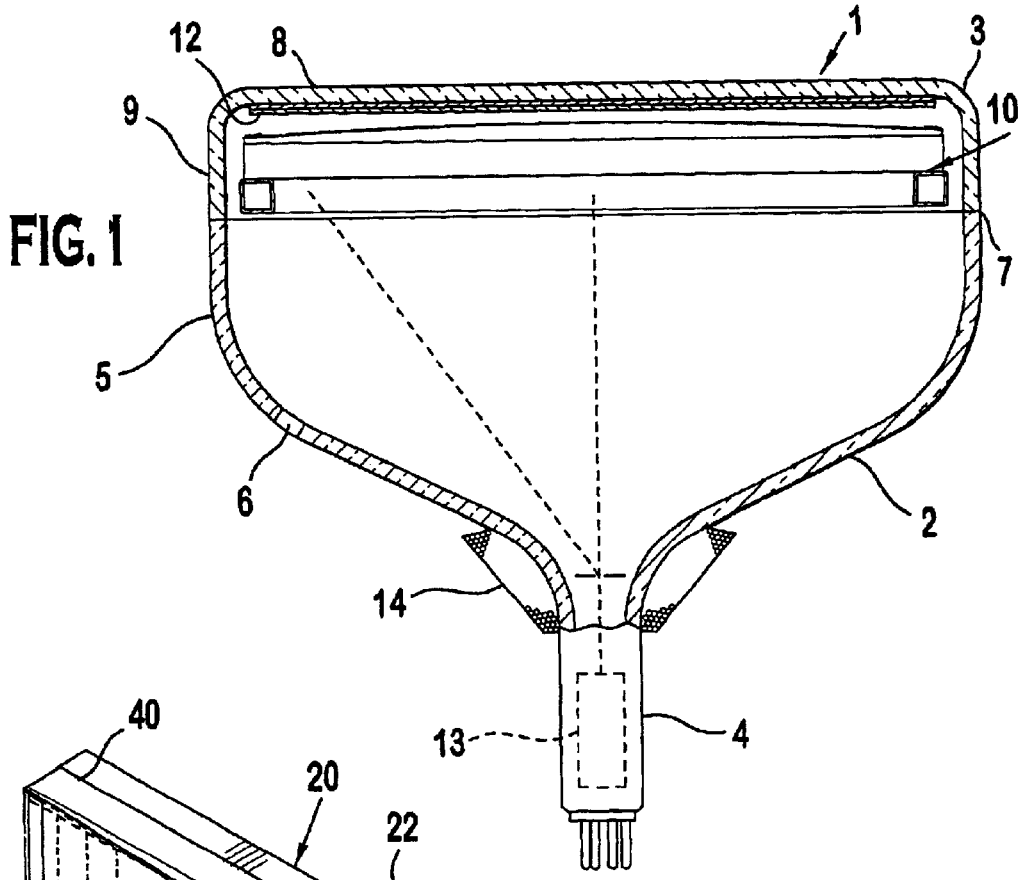
FIG. 1 is a cross sectional view of a CRT showing a tension mask support frame assembly.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A tension mask support frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask support frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
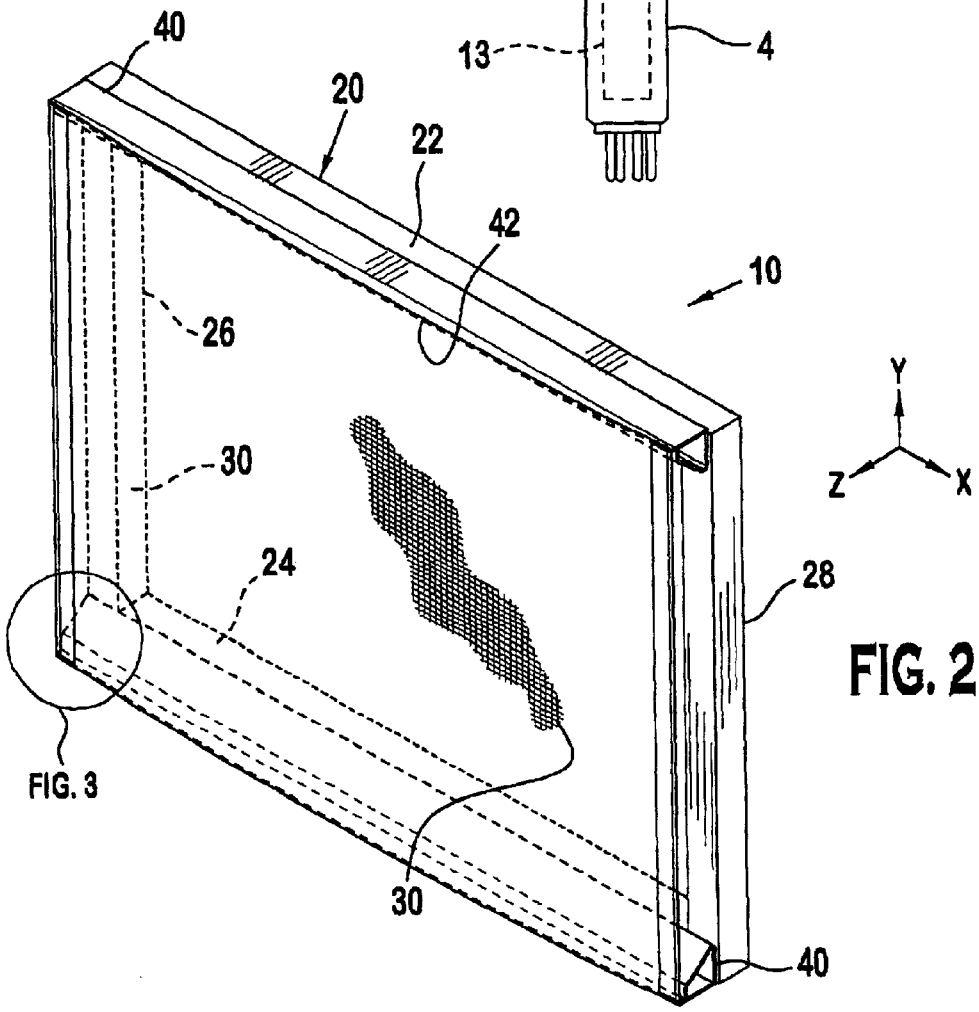
FIG. 2 is a perspective view of the tension mask support frame assembly.

The tension mask support frame assembly 10, as shown in FIG. 2, includes a frame 20 and a pair of support blade members 40 attached to the frame 20. The frame consists of two long sides 22 and 24, and two short sides 26 and 28 arranged in a plane for supporting a tension mask 30. The two long sides 22 and 24 of the frame 20 are parallel to a central major axis, X, of the CRT; and the two short sides 26 and 28 parallel a central minor axis, Y, of the CRT. The support blade members 40 are attached along the long sides 22 and 24 for supporting the tension mask 30 along blade edges 42 thereof. The mask 30 is shown in FIG. 2 as a flat planar surface for simplicity. However, it consists of a plurality of apertures 35 as best shown partially in FIGS. 3.

Referring now to FIG. 3, an exploded section of the tension mask frame assembly 10 is shown. The tension mask 30 is formed from a thin sheet of metal, typically steel or invar, which is etched or otherwise processed to produce a plurality of strands 32. Borders 36 located at opposite ends of the strands are attached to each of the support blade members 40 at an edge 42 by welding. The strands 32 extend parallel to the minor axis, Y, and a plurality of cross wires 34 are also conductive and are insulated from the strands 32 and extend parallel to the major axis, X. The combination of cross wires 34 and strands 32 form a plurality of precisely positioned apertures 35 through which the electron beam passes from the electron gun 13 to the screen 12. These apertures 35 define an array area 37 between the borders 36. Although the tension mask is firmly attached to and tensed between the support blade members 40, there is no ridged support along the minor axis, Y. The tension mask 30 is therefore somewhat susceptible to vibration transfer from the support blade members 40 to the tension mask 30.

The invention involves mitigating such vibrations through the use of at least one vibration damper 46, wherein a vibration damper 46 is provided along a border 36 of the tension mask 30 parallel to the minor axis Y and extending substantially between the long sides 22, 24. While only one vibration damper 46 will be described for simplicity, it should be understood that the preferred embodiment includes a pair of vibration dampers 46 each positioned along opposite ends of the tension mask 30 and damper 46 extends parallel to the minor axis Y. The vibration damper 46 is an elongated strip member, which is attached to each of the borders 36 at an attachment location 48. The elongated strip member has first and second ends mounted to a surface along the border 36 of the tension mask 30 and a substantial portion acting upon the surface of the border 36. The first and second ends are attached to the surface of the border 36 at attachment locations 48. The attachment is preferably accomplished by welding but may also include attachment by adhesives or other suitable techniques. It should be understood that although the vibration damper 46 is shown here as being attached along a screen facing side of the mask 30, it could alternatively be applied to the opposite gun facing side of the tension mask 30. The vibration damper 46, while fixed at both ends is in rubbing frictional contact with the shadow mask 30 along a substantial portion of its surface between the attachment locations 48. As the tension mask 30 tends to vibrate, the vibrations are damped due to friction from the rubbing of the border 36 with the damper and induced strain energy along the damper 46. The vibrational energy of the mask 30 can be communicated to the borders 36 by either tie bars in a web-type mask or cross wires in a strand mask. The damper 46 may optionally have a rough surface applied on the side which is in contact with the tension mask 30 in order to increase the friction between these components upon vibration.

The material of the vibration damper 46 may be optionally selected to have a coefficient of thermal expansion which is different from that of the tension mask 30. Selection of such a material is preferred in applications where additional tensioning or detensioning is required along the minor axis Y of the tension mask 30 during thermal cycling. It should also be understood that while the vibration damper 46 is shown as being applied to a tension mask 30, it is equally applicable to other types of masks such as shadow masks, tensed tie bar masks, focus masks and others.

FIG. 4 shows a first alternate embodiment in which the vibration damper 46 is substantially similar to that shown in FIG. 3 except that the attachment locations 148 are moved inward from the support blade member 40.

Figure 5:
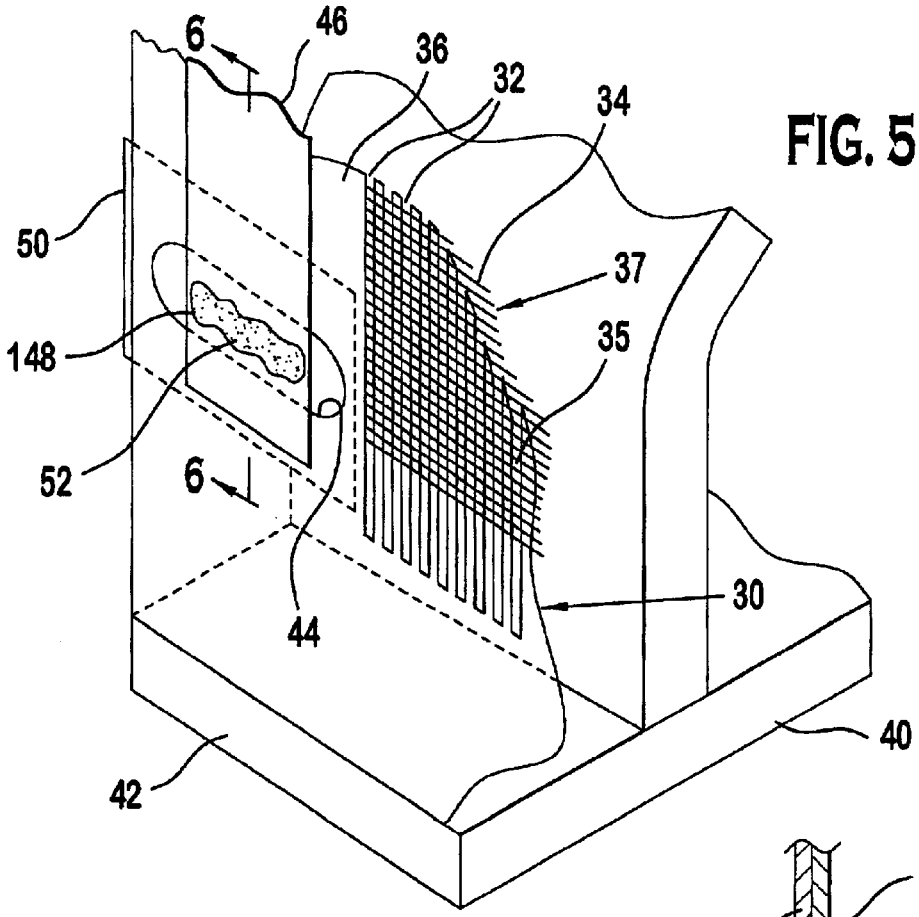
FIG. 5 is a partial perspective view similar to that of FIGS. 3 and 4 for a second alternate embodiment of the invention.
Figure 6:
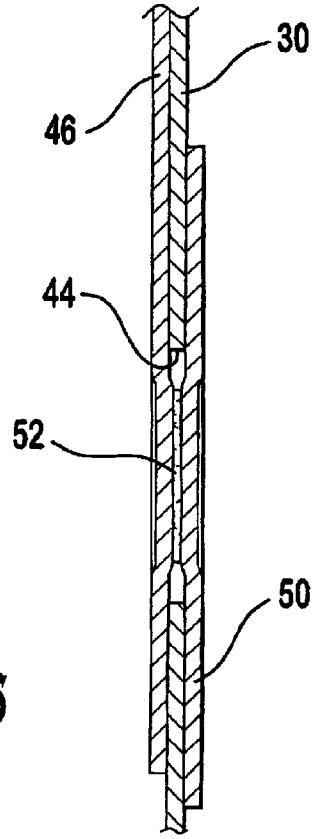
FIG. 6 is a cross sectional view taken along the line 6—6 of FIG. 5.

FIGS. 5 and 6 show a second alternate embodiment in which the vibration damper 46 is secured to the tension mask 30 by the application of a support plate 50 fastened to the vibration damper 46 through an opening 44 in the tension mask 30. As best shown in FIG. 6, an adhesive 52 is applied to the vibration damper 46 at the attachment location 148 within the opening 44. The support plate 50 is then applied to the opposite side of the tension mask 30 such that it contacts the adhesive 52 through the opening 44 to sandwich the tension mask 30 between the vibration damper 46 and the support plate 50. It should be understood in this embodiment as with each of the others, that the vibration damper 46 may be positioned on either the gun facing side or the screen facing side of the tension mask 30 while the support plate 50 is positioned on the side opposite the vibration damper 46.

Figure 7:
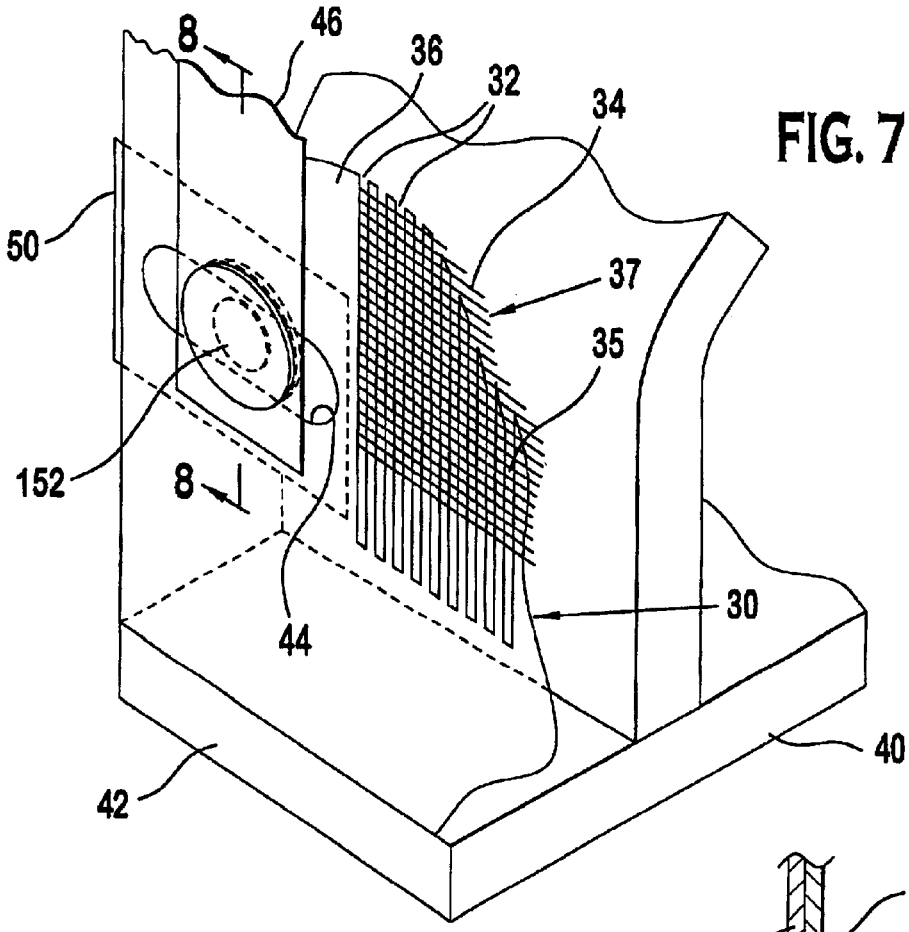
FIG. 7 is a partial sectional view similar to that of FIG. 3 for a third alternate embodiment of the invention.
Figure 8:
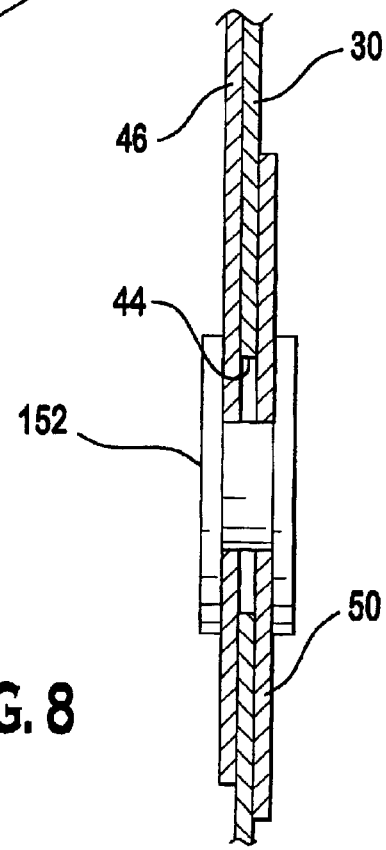
FIG. 8 is a cross sectional view taken along the line 8—8 of FIG. 7.

A third alternate embodiment is shown in FIGS. 7 and 8 wherein a support plate 50 is similarly positioned opposite the vibration damper 46 around the opening 44. In this embodiment, however, instead of applying an adhesive 52 at the attachment location 148, a pin 152 is utilized to secure the support plate 50 to the vibration damper 46. Once again, it should be understood in this embodiment as with each of the others, that the vibration damper 46 may be positioned on either the gun facing side or the screen facing side of the tension mask 30 while the support plate 50 is positioned on the side opposite the vibration damper 46.

Figure 9:
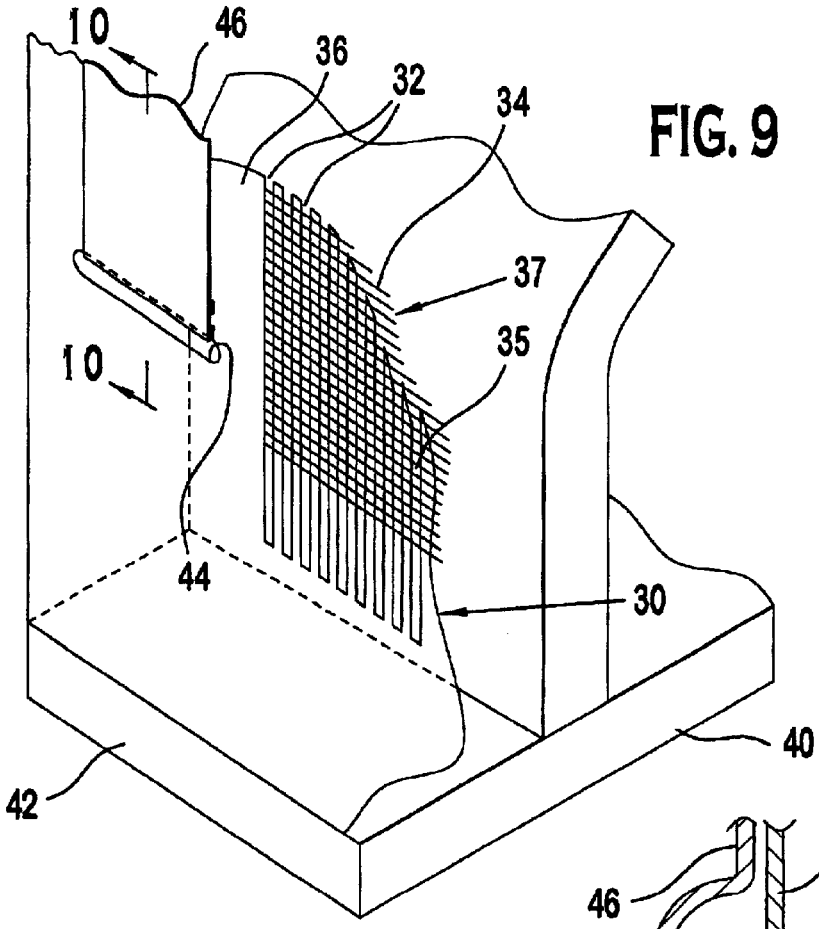
FIG. 9 is a partial perspective view similar to that of FIG. 3 showing a fourth alternate embodiment of the invention.
Figure 10:
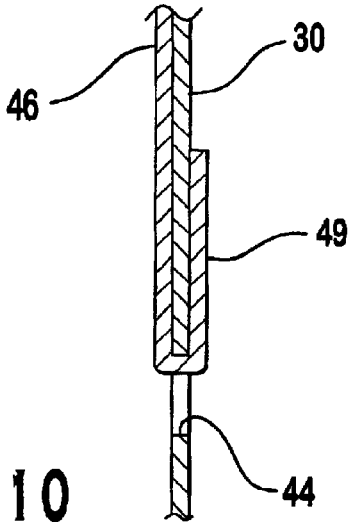
FIG. 10 is a cross sectional view taken along the line 10—10 of FIG. 9.

FIGS. 9 and 10 show a fourth alternate embodiment in which the vibration damper 46 is applied to the tension mask 30 by simply bending a portion thereof through the opening 44. As best shown in FIG. 10, a bent portion 49 extends through the opening 44 and around the opposite side of the tension mask 30 to sandwich the mask 30 between the bent portion 49 and the remainder of the vibration damper 46. It should be understood in this embodiment as with each of the others, that the vibration damper 46 may be positioned on either the gun facing side or the screen facing side of the tension mask 30 while the bent portion 49 is positioned on the side opposite the vibration damper 46.

Figure 11:
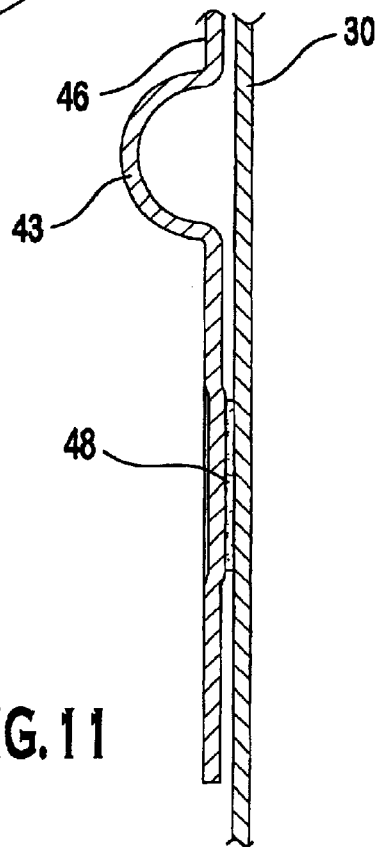
FIG. 11 is a cross sectional view of a fifth alternate embodiment of the invention.

FIG. 11 shows yet a fifth alternate embodiment in which a raised portion 43 is formed into the vibration damper 46. Here, the raised portion 43 comprises a semicircular bent section extending outward from the vibration damper 46 and located near the attachment location 48 along the tension mask 30. The raised portion 43 is especially useful in situations where materials having different coefficients of thermal expansion are utilized for the vibration damper 46. The raised portion 43 serves to allow the vibration damper 46 to expand along with the tension mask 30 during thermal cycling without applying excessive shear forces to the attachment location 48. The raised portion (43) elastically maintains structural integrity of the elongated strip member. It should be understood that the raised portion 43 is optionally applicable to any of the alternate embodiments discussed above.

Advantageously, since the vibration damper 46 is in frictional contact with the tension mask 30 over a substantial portion of its surface, it serves to improve vibration damping of the tension mask 30 along the minor axis.

What is claimed is:

1. A cathode ray tube (CRT) having a tension mask attached to a support frame, the support frame having long sides parallel to a major axis and short sides parallel to a minor axis, the tension mask having a first side and a second side, the first side including a vibration damper comprising:

an elongated strip member extending along a border of the first side of the tension mask parallel to the short sides of the frame, the elongated strip member having first and second ends mounted adjacent to the long sides along the border of the tension mask such that a major portion of its surface is in frictional contact with the border between the ends to receive vibration from the tension mask, the vibration damper is directly secured to the second side of the tension mask by a support plate located on the second side of the tension mask.

2. A CRT having a tension mask attached to a support frame, the tension mask including a vibration damper as recited in claim 1 further comprising a raised portion disposed between the first and second ends.

3. A CRT having a tension mask attached to a support frame, the tension mask including a vibration damper as recited in claim 1 wherein the first and second ends are positioned near a respective support blade member of the support frame, the blade member being near the long sides and parallel therewith.

4. A CRT having a tension mask attached to a support frame, the tension mask including a vibration damper as recited in claim 1 wherein the vibration damper is attached to the support plate by an adhesive.

5. A CRT having a tension mask attached to a support frame, the tension mask including a vibration damper as recited in claim 4 wherein the vibration damper is attached to the support plate by a pin.

6. A cathode ray tube (CRT) having a tension mask attached to a support frame, the support frame having long sides parallel to a major axis and short sides parallel to a minor axis, the tension mask having a first side and a second side, the tension mask including a vibration damper comprising:

an elongated strip member extending along a border of the first side of the tension mask parallel to the short sides of the frame, the elongated strip member having first and second ends mounted adjacent to the longs sides along the border of the tension mask such that a major portion of its surface is in frictional contact with the border between the ends to receive vibration from the tension mask, at least one of the ends of the vibration damper is directly secured to the second side of the mask through an opening in the border.

7. A CRT having a tension mask attached to a support frame, the tension mask including a vibration damper as recited in claim 6 further comprising a bent portion which extends through the opening and along the second side of the tension mask.

8. A CRT having a tension mask support frame, the tension mask including a vibration damper as recited in claim 6 further comprising a raised portion disposed between the first and second ends.

9. A CRT having a tension mask support frame, the tension mask including a vibration damper as recited in claim 6 wherein the vibration damper is attached along a screen facing side of the tension mask.

10. A cathode ray tube (CRT) having a tension mask attached to a support frame, the support frame having long sides parallel to a major axis and short sides parallel to a minor axis, the tension mask having a first side and a second side, the tension mask including a vibration damper comprising:

an elongated strip member having first and second ends mounted to a surface along a border of the first side of the tension mask and a substantial portion acting upon the surface of the border to receive vibration from the border;

the elongated strip member having a raised portion formed between the first and second ends, the raised portion having a semicircular bent section extending outward from the vibration damper such that the elongated strip member expands along with the tension mask during thermal cycling.

11. A CRT having a tension mask attached to a support frame, the tension mask including a vibration damper as recited in claim 10 wherein the first and second ends are attached near a support blade member of the support frame, the blade member being near the long sides and parallel therewith.

12. A CRT having a tension mask attached to a support frame, the tension mask including a vibration damper as recited in claim 10 wherein the first and second ends are attached to the tension mask at a location remote from a support blade member of the support frame.

13. A CRT having a tension mask attached to a support frame, the tension mask including a vibration damper as recited in claim 10 wherein the tension mask further comprises an opening through which the vibration damper is attached to a support plate located on the second side of the tension.

14. A CRT having a tension mask attached to a support frame, the tension mask including a vibration damper as recited in claim 13 wherein the vibration damper is attached to the support plate by an adhesive.

15. A CRT having a tension mask attached to a support frame, the tension mask including a vibration damper as recited in claim 14 wherein the vibration damper is attached to the support plate by a pin.

16. A CRT having a tension mask attached to a support frame, the tension mask including a vibration damper as recited in claim 10 wherein the vibration damper is secured through an opening in the border.

17. A CRT having a tension mask attached to a support frame, the tension mask including a vibration damper as recited in claim 16 further comprising a bent section which extends through the opening and along the second side of the tension mask.

18. A (CRT) having a tension mask attached to a support frame, the tension mask including a vibration damper, as recited in claim 10 wherein the first and second ends are directly attached to the support blade members on the long sides.

* * * * *